US005603364A

United States Patent [19]

Kerssies

[11] Patent Number: 5,603,364

[45] Date of Patent: Feb. 18, 1997

[54] SPOUT FOR A FUEL DISPENSING NOZZLE

[75] Inventor: Geert Kerssies, Vianen, Netherlands

[73] Assignee: OPW Fueling Components Europe B.V., Netherlands

[21] Appl. No.: 499,783

[22] Filed: Jul. 7, 1995

Related U.S. Application Data

[63] Continuation-in-part of PCT/EP94/00064 Jan. 7, 1994.

[51] Int. Cl. [6] ..... B65B 1/04

[52] U.S. Cl. ..... 141/392; 141/206; 239/104

[58] Field of Search ..... 141/206–229, 141/392; 239/104, 120; 222/571; 137/513, 512.5

[56] References Cited

U.S. PATENT DOCUMENTS

| | | | |
|---|---|---|---|
| 2,004,203 | 6/1935 | Howell | 221/84 |
| 2,035,438 | 3/1936 | Warren | 221/84 |
| 2,207,285 | 7/1940 | Chapman et al. | 221/84 |
| 2,578,926 | 12/1951 | Douglas | 141/213 |
| 2,705,102 | 3/1955 | Slattery | 141/217 |
| 4,214,614 | 7/1980 | Pyle | 141/1 |
| 4,537,335 | 8/1985 | Rangwala et al. | 141/392 |
| 5,004,009 | 4/1991 | Bunce | 137/513 |
| 5,137,187 | 8/1992 | Nichols et al. | 141/392 |
| 5,273,087 | 12/1993 | Koch et al. | 141/206 |
| 5,377,729 | 1/1995 | Reep | 141/206 |

FOREIGN PATENT DOCUMENTS

| | | |
|---|---|---|
| 0337871 | 10/1989 | European Pat. Off. . |
| 931756 | 11/1955 | Germany . |

*Primary Examiner*—Henry J. Recla
*Assistant Examiner*—Steven O. Douglas
*Attorney, Agent, or Firm*—Webb Ziesenheim Bruening Logsdon Orkin & Hanson, P.C.

[57] ABSTRACT

A spout for a fuel dispensing nozzle which includes a main channel for supplying fuel to the outflow end of the spout; a medium channel for supplying medium to a blocking mechanism of the nozzle, in which the channel is arranged internally in the spout and separated from the main channel; a cap member for closing the outflow end against an edge thereof; and a connecting mechanism which extends internally in the spout between the cap member and the other end in order to provide a coupling between the cap member and the main closing mechanism of the fuel dispensing nozzle.

17 Claims, 4 Drawing Sheets

SPOUT FOR A FUEL DISPENSING NOZZLE

This application is a continuation-in-part of International Patent Application No. PCT/EP94/00064, filed 7 Jan. 1994, and published 21 Jul. 1994 and designating inter alia the United States of America.

BACKGROUND OF THE INVENTION

Increasingly strict environmental demands are being made for fuel filling stations. One of the sources of contamination by fuel is leakage of the filling nozzle. Existing fuel filling stations are faced with large investment to prevent leakage of fuel into the groundwater. When it occurs leakage of the nozzle also causes much inconvenience for users, particularly for owners of diesel vehicles, because of damage to clothing, footwear and the like in the form of stains. Particularly in the case of diesel fuel a penetrating odor is further disseminated by evaporated liquid which is unhealthy and contaminates the environment.

In the Netherlands Patent Application No. NL-A-88.00959 is described a design for a filling nozzle which is provided with a closing valve close to an outflow end—but not against the forward edge thereof—of the fuel nozzle. This filling nozzle has not however found application in practice since it is a wholly new design of filling nozzle entailing considerable investment.

SUMMARY OF THE INVENTION

The present invention provides a pipe piece for a filling nozzle comprising:

- a main channel for supplying fuel to the outflow end of the pipe piece;
- a medium channel for supplying medium to a blocking mechanism of the filling nozzle, which channel is arranged internally in the pipe piece and separated from the main channel;
- a cap member for closing the outflow end against an edge thereof; and
- connecting means which extend internally in the pipe piece between the cap member and the other pipe end in order to provide coupling between the cap member and main closing means of the filling nozzle.

In addition to solving the above problems the pipe piece according to the present invention has a number of advantages including facility of manufacture thereof, extreme closure of the outer end thereof after the pipe end has been withdrawn from a fuel tank filling pipe of a vehicle, as well as the possibility of replacing an existing pipe piece for a filling nozzle, wherein adaptations to the remaining mechanism of the filling nozzle can be omitted.

Further advantages, features and details of the present invention will become apparent in the light of the following description of a preferred embodiment thereof with reference to the annexed drawings, in which:

DESCRIPTION OF THE PREFERRED EMBODIMENTS

Figure 1:
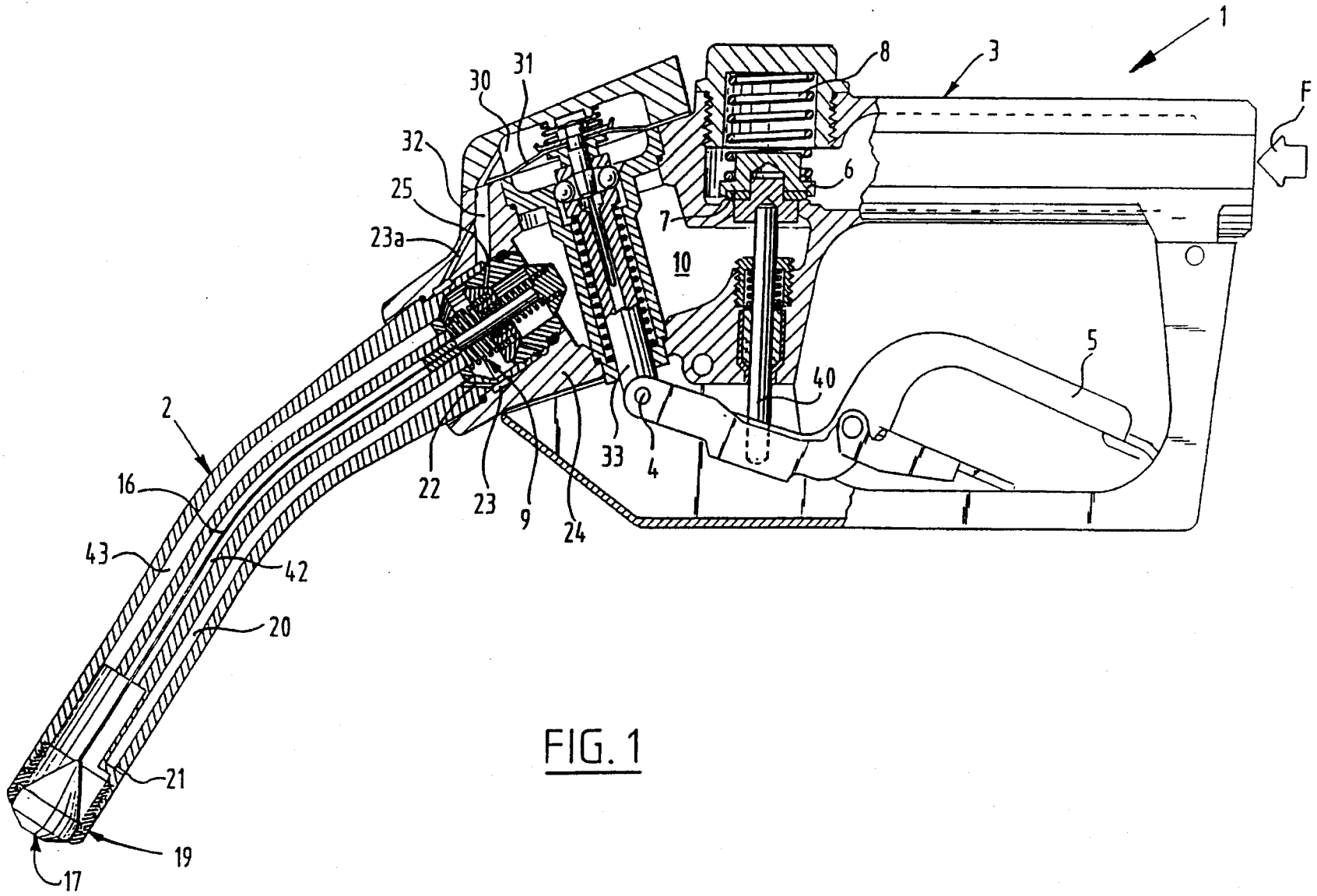
FIG. 1 shows a section through a preferred embodiment of a filling nozzle according to the present invention.

A filling nozzle 1 (FIG. 1) is provided with a pipe piece 2 according to the present invention. In respect of the components not forming part of the pipe piece 2 the filling nozzle shown is commercially available under the trademark OPW. For operation thereof reference is made in addition to the following description to the models commercially available particularly in Europe and the USA and to the information relating thereto from the relevant distributors.

Fuel is supplied under some pressure through a handgrip 3 via a filling hose (not shown) as according to arrow F. When a control lever 5 pivotable at pin 4 is operated, a valve body 6 is raised from its seat 7 counter to spring pressure of a coil spring 8. When valve body 6 is opened the fuel flows into the space 10 and therefrom into the main channel in the interior of pipe piece 2.

When valve body 6 is opened a valve mechanism 9 arranged close to a first end of pipe piece 2 is opened by the liquid pressure of for instance 2 bar or more.

Due to the liquid pressure (see FIG. 4 in particular) two frusto-conical valve bodies 11 and 12 in the pipe piece 2 which are coupled by means of a coil spring 13 are raised counter to the spring pressure of both coil spring 13 and a second coil spring 13*a* from their respective seats and the liquid can flow along the outside of these valve bodies through a relatively narrow space 14, whereby the flow speed is increased. The preceding and following spaces are wider than space 14. Valve body 12 is connected via a stem 15 thereof and a wire 16 to a cap member 17 which, in closed position (see FIG. 2), closes and seals the pipe piece 2 against an edge 18 of the outflow end 19 thereof.

Arranged in the interior of pipe piece 2 is a medium channel 20 which debouches into an opening 21 in the side wall of pipe piece 2 close to the outflow end 19. When the valve mechanism 9 is opened a so-called venturi effect is generated because of the form of the space 14 and air is drawn in via opening 21, medium channel 20, a channel 22 into an annular space 23 in a collar 24 and a channel 25 leading from the annular space 23 into the annular space 14. The entrained air is discharged again through pipe piece 2 together with the fuel.

As soon as the liquid level in the filling pipe of the tank for filling reaches opening 21, air is drawn due to the venturi effect out of a space 30 (see FIG. 1) which is situated behind a diaphragm 31 and which communicates via a channel 32 with channel 15. An underpressure is thus created in this space 30 and a pin 33 which is provided at its bottom end with pivot point 4 is pulled by diaphragm 31 in upward direction whereby valve body 6 is moved upward via pin 40, which is likewise fixedly connected to control handle 5, and the supply of fuel is stopped.

Figure 2:
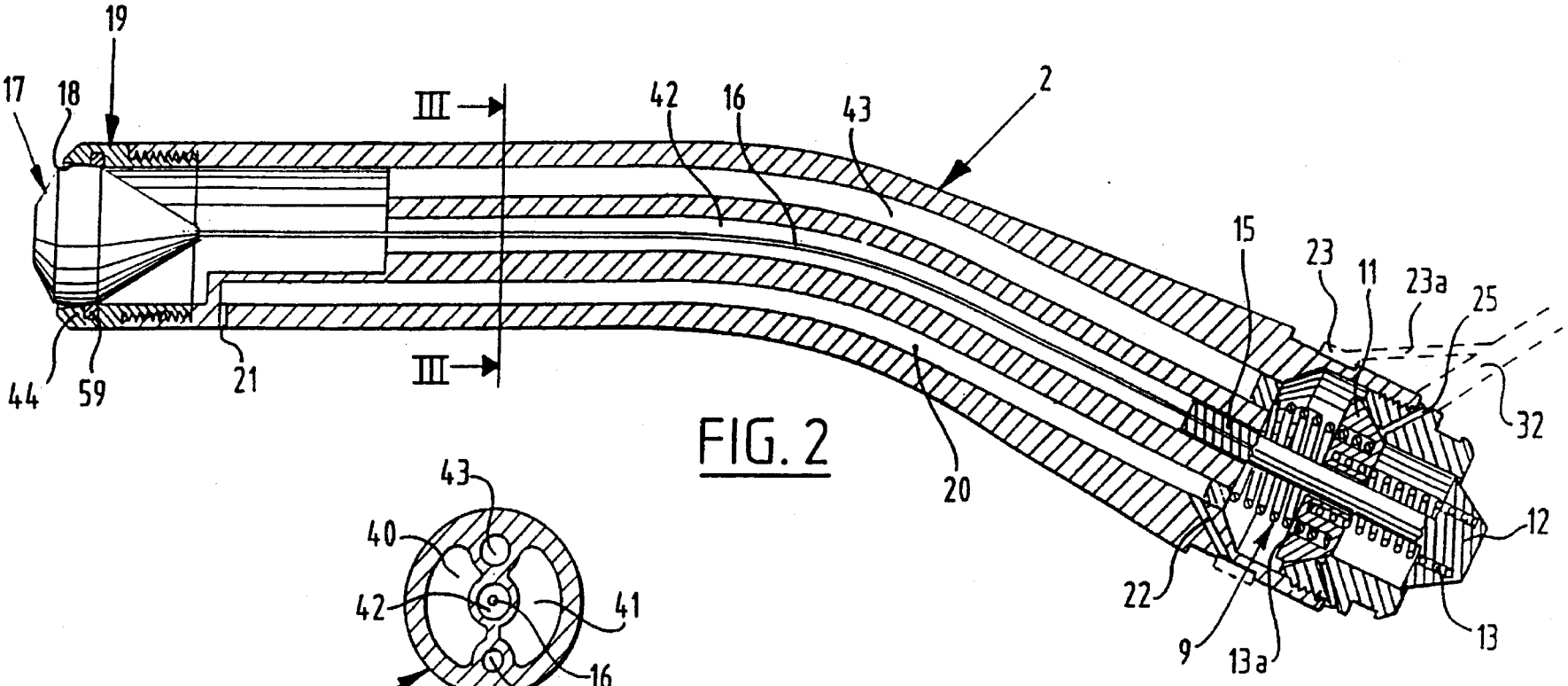
FIG. 2 shows a section through the pipe end of the filling nozzle of FIG. 1.

Valve bodies 11 and 12 are simultaneously closed by the action of the springs 13 and 13*a* and urged into rest position and the cap member 17 is carried into its closing position as shown in FIG. 2. Cap member 17 (see FIG. 4 in particular) is preferably constructed from a first conical part 58, which in the closing position shown in FIG. 2 seals against a sealing ring 59, and a second part 60 which can be snapped thereon so that the wire 16 can be fastened thereunder in cap member 17 using a screw element 61. So that as little fuel as possible remains clinging to the outside of the cap member the forward part is preferably embodied in the form of a truncated cone.

Figure 3:
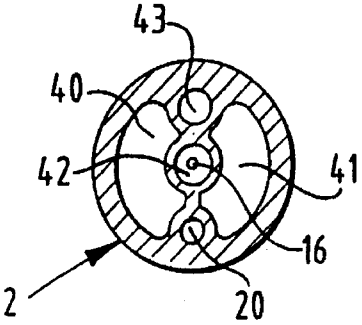
FIG. 3 shows a section along line III—III in FIG. 2.

As can be seen particularly in FIG. 3, a pipe piece 2 in curved form is preferably formed from one piece of stainless metal, for instance aluminum. The pipe piece is preferably provided close to its outflow end with a screwable collar 44 of hardened metal so that in the case of breakage this collar can be easily replaced. Pipe piece 2 has in cross section main parts 40 and 41, which form the main channel for passage of the liquid, in addition to a central channel 42 and a dummy channel 43 which is only included in the present embodiment to simplify manufacture. Central channel 42 serves to guide the connecting wire 16.

Figure 4:
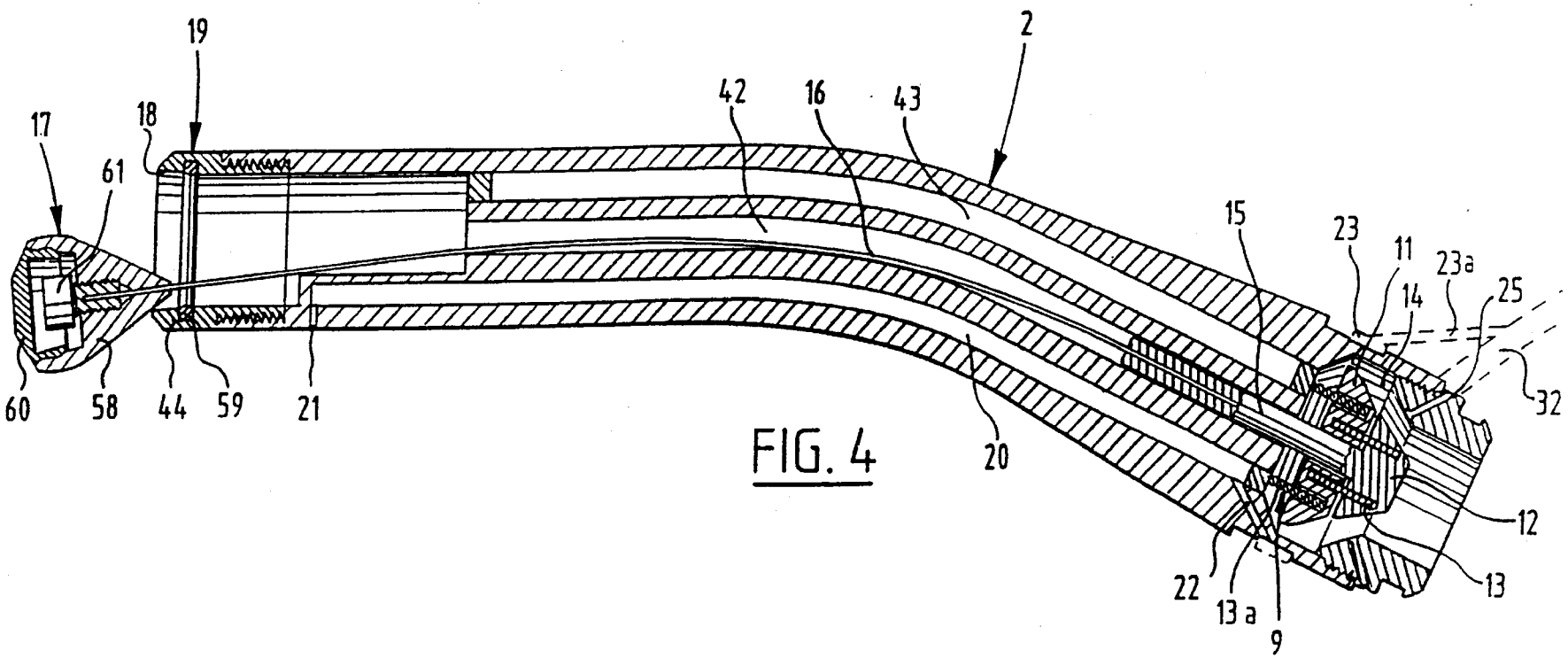
FIG. 4 shows a section through the pipe end of FIG. 3 in the open position.

As can be seen in FIGS. 2 and 4, the central channel preferably ends at a distance from the cap member 17 so that, when the filling nozzle is open, wire 16 can assume a slightly oblique position at the portion located most closely to the cap member in order to limit to a minimum the disruption of the liquid flow through the cap member, for which purpose the cap member likewise has a conical form.

Figure 5:
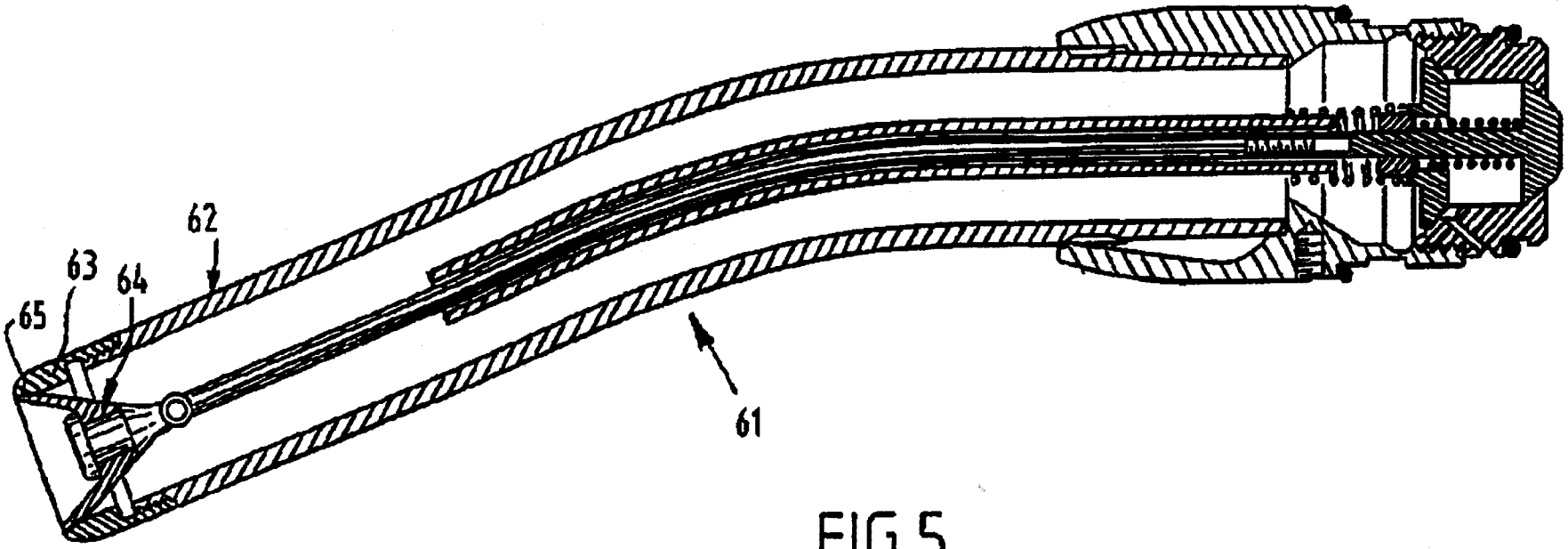
FIG. 5 illustrates another embodiment of the invention.

FIG. 5 shows another embodiment of the invention. The embodiment shown in FIG. 5 includes a fueling nozzle 61 having a pipe piece 62 of aluminum and an end part 63 of stainless steel. A valve part 64 of flexible polyurethane closes against a sealing face 65 of end part 63. The embodiment shown in FIG. 5 has the further advantage that the flexible valve part 64 will not hook behind an obstacle in the open position of the valve part.

The preferred embodiments shown and described above have a number of advantages, including convenience of fitting in existing filling nozzles, since only an existing pipe piece has to be replaced by a pipe piece according to the present invention, while retaining the operation of the blocking mechanism.

It will be apparent that the filling nozzle and the pipe piece according to the present invention are suitable for all possible fuels, in particular vehicle fuel such as—but not exclusively—diesel fuel. The rights applied for are defined in the first instance by the following claims.

What is claimed is:

1. A pipe piece for a filling nozzle comprising:

a main channel defined within said pipe piece for supplying fuel to an outflow end of said pipe piece from an inflow end of said pipe piece;

a medium channel defined within said pipe piece and separated from said main channel to ensure separation of a medium and the fuel, said medium channel being adapted for supplying the medium to a fuel stop mechanism positioned in the filling nozzle;

a cap member for closing said outflow end against an edge thereof;

a main closing means which detachably seals said inflow end of said pipe piece; and connecting means which extend internally in said pipe piece to provide coupling between said cap member and said main closing means of said pipe piece.

2. The pipe piece as claimed in claim 1, wherein said connecting means includes a wire and an internal central channel defined within said pipe piece which is separate from all other defined channels for guiding said wire through said pipe piece.

3. The pipe piece as claimed in claim 1, further including a valve mechanism to create a venturi action for drawing in air through said medium channel.

4. The pipe piece as claimed in claim 3, wherein said valve mechanism comprises two truncated cone-shaped valve bodies.

5. The pipe piece as claimed in claim 1, wherein said main channel ends at a distance from said cap member.

6. The pipe piece as claimed in claim 1, wherein said medium channel comprises:

an opening defined in said pipe piece near said outflow end to receive the medium;

a first channel;

a second channel; and a third channel, wherein said first channel provides communication between said opening and said second channel, said second channel provides communication to an annular space between said pipe piece and a collar of the filling nozzle, and said third channel provides communication between said annular space and said inflow end of said pipe piece.

7. The pipe piece as claimed in claim 1, further including a dummy channel defined within said pipe piece which is separated from all other defined channels extending opposite said medium channel with said main channel therebetween.

8. The pipe piece as claimed in claim 1, wherein said cap member has a truncated cone shape on a forward part thereof.

9. The pipe piece as claimed in claim 1, wherein said outflow end further includes an internal sealing face and said cap member is configured as a flexible valve part for closing said sealing face and thereby said outflow end.

10. A pipe piece for a filling nozzle comprising:

a main channel defined within said pipe piece for supplying fuel to an outflow end of said pipe piece from an inflow end of said pipe piece;

a medium channel defined within said pipe piece and separated from said main channel to ensure separation of a medium and the fuel, said medium channel being adapted for supplying the medium to a fuel stop mechanism positioned in the filling nozzle;

a cap member for closing said outflow end against an edge thereof;

a main closing means which detachably seals said inflow end of said pipe piece; and connecting means which extend internally in said pipe piece to provide coupling between said cap member and said main closing means of said pipe piece, wherein said connecting means includes a wire and an internal central channel defined within said pipe piece which is separate from all other defined channels for guiding said wire through said pipe piece.

11. The pipe piece as claimed in claim 10, wherein said main channel ends at a distance from said cap member.

12. The pipe piece as claimed in claim 10, wherein said medium channel comprises:

an opening defined in said pipe piece near said outflow end to receive the medium;

a first channel;

a second channel; and a third channel, wherein said first channel provides communication between said opening and said second channel, said second channel provides communication to an annular space between said pipe piece and a collar of the filling nozzle, and said third channel provides communication between said annular space and said inflow end of said pipe piece.

13. The pipe piece as claimed in claim 10, further including a dummy channel defined within said pipe piece which is separated from all other defined channels extending opposite, said medium channel with said main channel therebetween.

14. The pipe piece as claimed in claim 10, wherein said cap member has a truncated cone shape on forward part thereof.

15. The pipe piece as claimed in claim 10, wherein said outflow end further includes an internal sealing face and said cap member is configured as a flexible valve part for closing said sealing face and thereby said outflow end.

16. A pipe piece for a filling nozzle comprising:

a main channel defined within said pipe piece for supplying fuel to an outflow end of said pipe piece from an inflow end of said pipe piece;

a medium channel defined within said pipe piece and separated from said main channel to ensure separation of a medium and the fuel, said medium channel being adapted for supplying the medium to a fuel stop mechanism positioned in the filling nozzle;

a cap member for closing said outflow end against an edge thereof;

a main closing means which detachably seals said inflow end of said pipe piece; and connecting means which extend internally in said pipe piece to provide coupling between said cap member and said main closing means of said pipe piece; and a valve mechanism to create a venturi action for drawing in air through said medium channel.

17. The pipe piece as claimed in claim 16, wherein said valve mechanism comprises two truncated cone-shaped valve bodies.

* * * * *

UNITED STATES PATENT AND TRADEMARK OFFICE

CERTIFICATE OF CORRECTION

PATENT NO. : 5,603,364

DATED : February 18, 1997

INVENTOR(S) : Geert Kerssies

It is certified that error appears in the above-indentified patent and that said Letters Patent is hereby corrected as shown below:

Claim 13 Line 66 Column 4 after "opposite" delete --,--.

Claim 14 Line 2 Column 5 after "on" insert --a--.

Signed and Sealed this

Sixth Day of May, 1997

*Attest:*

*Attesting Officer*

BRUCE LEHMAN

*Commissioner of Patents and Trademarks*